US006705047B2

(12) United States Patent
Yulkowski

(10) Patent No.: US 6,705,047 B2
(45) Date of Patent: Mar. 16, 2004

(54) DOOR AND DOOR CLOSER ASSEMBLY

(76) Inventor: Leon Yulkowski, 4390 Derry Rd., Bloomfield Hills, MI (US) 48302

( * ) Notice: Subject to any disclaimer, the term of this patent is extended or adjusted under 35 U.S.C. 154(b) by 0 days.

(21) Appl. No.: 09/859,188

(22) Filed: May 16, 2001

(65) Prior Publication Data

US 2002/0170249 A1 Nov. 21, 2002

(51) Int. Cl.[7] ..... E05F 11/24

(52) U.S. Cl. ..... 49/346; 52/656.3; 52/207; 52/213; 52/210; 49/501; 49/503; 16/65; 16/71

(58) Field of Search ..... 52/210, 211, 213, 52/656.3, 656.4, 207, 240.66; 49/503, 504, 380, 324, 346, 501; 16/65, 71, 80, DIG. 10

(56) References Cited

U.S. PATENT DOCUMENTS

| | | | | |
|---|---|---|---|---|
| 3,996,642 A | | 12/1976 | Atkins | |
| 4,288,887 A | | 9/1981 | Johnson et al. | |
| 4,551,946 A | * | 11/1985 | Yoshida et al. | 49/340 |
| 4,979,261 A | | 12/1990 | Lasier et al. | |
| 5,325,633 A | * | 7/1994 | Magoon | 49/504 |
| 5,829,508 A | * | 11/1998 | DeBower et al. | 160/371 |
| 5,832,562 A | * | 11/1998 | Luca | 16/71 |
| 5,845,439 A | * | 12/1998 | Hendley | 52/204.1 |
| 5,941,023 A | * | 8/1999 | Mamchych | 49/365 |
| 6,041,548 A | * | 3/2000 | Miller | 49/345 |
| 6,138,412 A | * | 10/2000 | Rieckmann et al. | 49/349 |
| 6,145,942 A | * | 11/2000 | Borgen | 312/138.1 |
| 6,185,871 B1 | * | 2/2001 | Wang | 49/501 |
| 6,253,417 B1 | * | 7/2001 | Rusiana | 16/82 |
| 6,260,304 B1 | * | 7/2001 | Groeneveld | 49/395 |
| 6,298,520 B1 | * | 10/2001 | Blickhahn et al. | 16/71 |
| 6,393,779 B1 | * | 5/2002 | Boldt | 52/210 |
| 6,397,431 B1 | * | 6/2002 | Alonso | 16/72 |

FOREIGN PATENT DOCUMENTS

| | | | | |
|---|---|---|---|---|
| FR | 2623235 | * | 11/1987 | E06B/1/02 |
| JP | 6-146703 | * | 5/1994 | E05D/15/58 |

OTHER PUBLICATIONS

Dorma Installation Instructions: ITS 96–1 (Wood Door and Frame) Closer in Door Track in Frame, 8/00.
DORMA 7900 Series Surface Applied Door Closer Catalog, 7.98CT 15M USA 07000224.

* cited by examiner

*Primary Examiner*—Carl D. Friedman
*Assistant Examiner*—Chi Q. Nguyen
(74) *Attorney, Agent, or Firm*—Kevin G. Mierzwa

(57) ABSTRACT

A door assembly includes a door frame having a horizontal header along the top thereof. A firestop extends downwardly from the header, the firestop has a plurality of sides defining a channel therein. The firestop has an at least partially open side to allow the channel to be open and receive a closer assembly. A door closer assembly is coupled to the door. The door closer assembly has a biasing assembly and an arm having a first end and a second end. The first end is rotatably coupled to the biasing assembly and is slidably coupled to the channel.

23 Claims, 4 Drawing Sheets

DOOR AND DOOR CLOSER ASSEMBLY

TECHNICAL FIELD

The present invention relates generally to an entry door for a building and, more specifically, to a building door having a door closer guide track formed as a portion of the firestop of the door.

BACKGROUND OF THE INVENTION

Installing doors into buildings under construction typically requires the assistance of various tradesmen. For example, for one opening, tradesmen such as carpenters, painters, glaziers, electricians and drywallers are required to complete the installation of a door. Other tradesmen may also be used for the installation of a door closer.

One problem associated with the use of tradesmen for completing the installation of a door is that alignment of the devices may have to be verified using several tradesmen. Tradesmen are expensive and therefore it is desirable to minimize adjustment and alignment procedures on the construction site.

Door closers are commonly used on commercial doors. Door closers may take many forms. Typically, door closers are mounted on the door and extend to the door frame. A spring, cam or other biasing members urges the door shut through the use of an arm.

Another type of door closer provides a slider mortised in the door frame that allows one end of the door closer arm to slide therein. One problem with mortising a track within the door frame is that further tradesmen are required on the construction site to mortise the closer track into the door frame. Such an operation is labor intensive and therefore costly.

Firestops are typically provided within a door frame. Many times the door frames are metal and have an integrally formed firestop therearound. The firestop is typically an extension of about five-eighths of an inch that extends into the door opening against which the door closes. The firestop along with weather stripping eliminates the air gap between the door and the door frame. The firestop may be integrally formed with the door frame or may be assembled as a separate add on piece.

It would therefore be desirable to provide a door assembly that reduces the cost of the installation of the door while incorporating features of the door closer assembly therein.

SUMMARY OF THE INVENTION

The present invention reduces the cost of assembly of the door by providing a firestop having a novel design which incorporates a slider channel therein for slidably receiving one end of the slider assembly.

In one aspect of the invention, a door assembly includes a door frame having a horizontal header along the top thereof. A firestop extends downwardly from the header, the firestop has a plurality of sides defining an open channel therein. The firestop has an at least partially open side to define the open channel. A door is rotatably mounted within the door frame. A door closer assembly is coupled to the door. The door closer assembly has a biasing assembly and an arm having a first end and a second end. The first end is rotatably coupled to the biasing assembly and is slidably coupled to the channel.

In a further aspect of the invention, a method of forming a door assembly comprises:

mounting a firestop to a header of a door frame, said firestop having an at least partially open side and a channel defined therein;

mounting a closer assembly having an arm extending therefrom to a door; and slidably coupling the arm to the channel.

One advantage of the invention is that the cost of assembling the door by tradesmen is reduced because the door closer assembly may be mounted in a factory environment. This leads to another advantage in which the door assembly can be aligned and tested in the assembled position.

A further advantage of the invention is that doors without closer assemblies according to the present invention may be retrofitted to provide a door closer according to the present invention.

Other advantages and features of the present invention will become apparent when viewed in light of the detailed description of the preferred embodiment when taken in conjunction with the attached drawings and appended claims.

DETAILED DESCRIPTION OF THE PREFERRED EMBODIMENT

Figure 1:
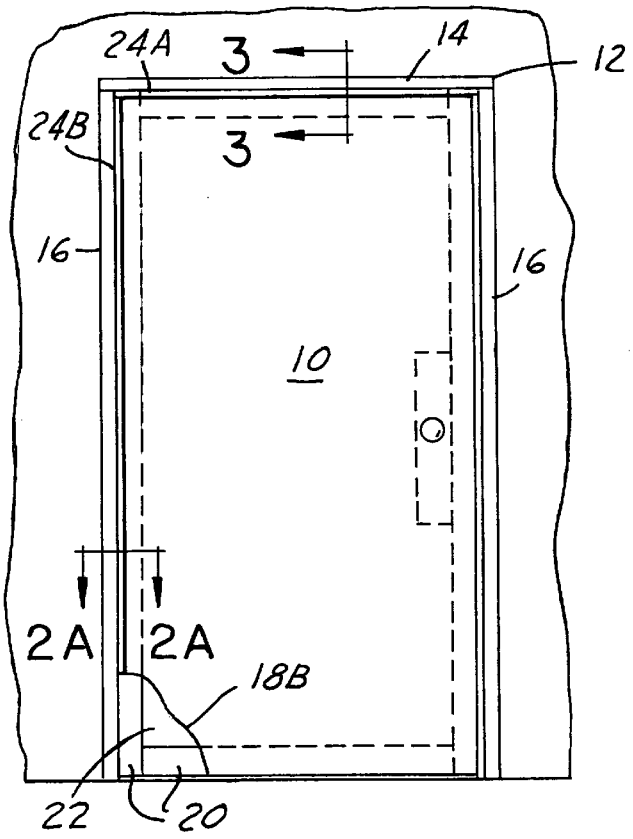
FIG. 1 is an elevational view of a door frame defining an opening for use according to the present invention.

In the following figures, the same reference numerals will be used to illustrate the same components in the various views. The present invention is described with respect to commercial doors and has various geometrically shaped frame, track and other components. These shapes are illustrated but not meant to be limiting unless otherwise specified in the claims.

Referring now to FIG. 1, a door 10 is illustrated having a frame 12 around its perimeter. Frame 12 comprises a horizontal header 14 and vertical jambs 16. Horizontal header 14 and vertical jambs 16 may be formed of a variety of materials including wood, metal or a composite material. Preferably in commercial door environments, horizontal header 14 and vertical jambs 16 are formed from metal.

Door 10 has a pair of faces 18A and 18B, which may be referred to as inner and outer, respectively. A portion of outer face 18B is cut away to reveal the core of door 10. A number of spacers 20 are typically incorporated to hold inner and outer faces 18A, 18B a predetermined distance apart. Spacers 20 are commonly used in the industry. Spacers 20 may be formed from various materials including cardboard, wood blocks, expanded polystyrene, metal, honeycomb, or fire resistant material. A void 22 is formed between spacers 20 and outer faces 18A. Void 22 may be sized to receive an integrated door closer to urge the door into a closed position as will be further described below.

Door frame 12 has firestops 24A and 24B positioned to extend into the door opening. Firestop 24A is positioned on horizontal header 14. Firestops 24B are positioned on jambs 16. Firestops 24A, 24B closes the air gap between door 10 and frame 12.

Figure 2A:
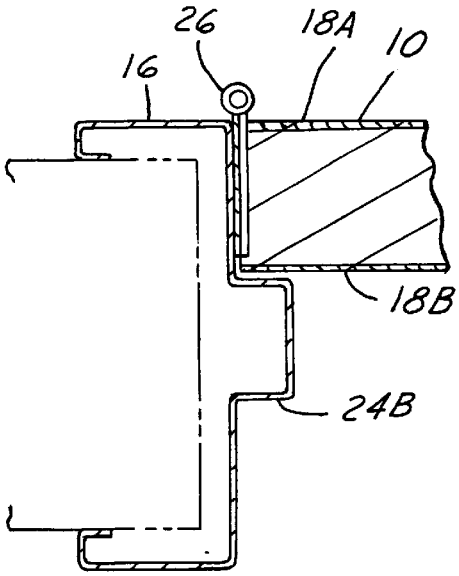
FIG. 2A is a cross-sectional view of a door in a closed position according to the present invention.
Figure 2B:
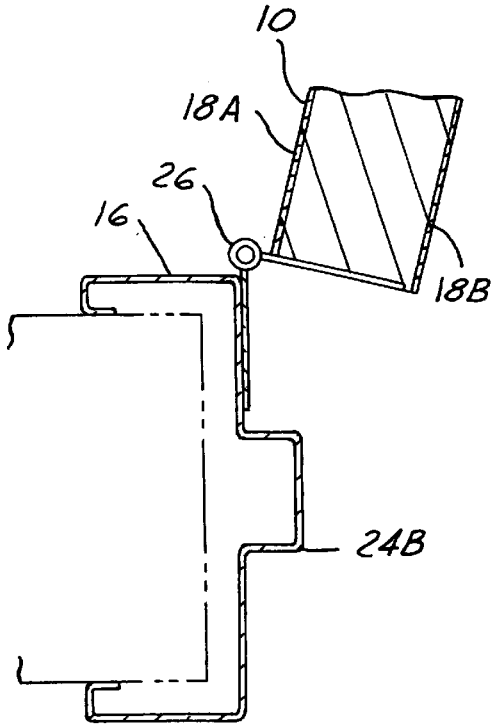
FIG. 2B is a cross-sectional view of a door in an open position according to the present invention.

Referring now to FIGS. 2A and 2B, door 10 is shown in various positions. In FIG. 2A, door 10 is illustrated in a closed position while in FIG. 2B door 10 is illustrated in an open position. A hinge 26 is used to rotatably couple door 10 to jamb 16. As illustrated, hinge 26 is a conventional pin-type hinge. However, those skilled in the art will recognize various alternative types of hinges may be employed. As shown best in FIG. 2A, outer face 18B, which indicates the inside of the door, closes against or nearly against firestop 24.

Figure 3:
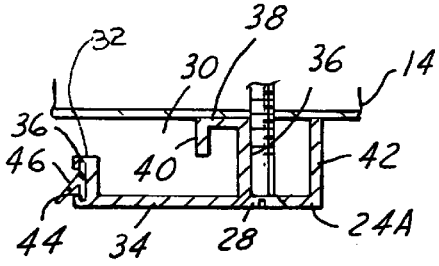
FIG. 3 is a cross-sectional view of a firestop mounted to a door frame header according to the present invention.

Referring now to FIG. 3, horizontal header 14 is illustrated with firestop 24A coupled to header 14. Firestop 24A is coupled to header 14 with a screw or other type of fastener 28. Firestop 24A has a channel 30 defined therein. Channel 30, as illustrated, is G-shaped and has an at least partially open wall 32. As illustrated, wall 32 extends only about half the thickness of firestop 24A. In addition to partially open wall 32, firestop 24A has a horizontal wall 34 extending in a plane parallel to horizontal header 14. A vertical wall 36 extends between horizontal wall 34 and a second horizontal wall 38 positioned adjacent or against header 14. A partial vertical wall 40 extending into channel 30 may be used to help secure and guide a slider therein as will be further described below.

Firestop 24A may have a mounting portion 42 adjacent to channel portion 30. Screw 28 may be mounted through mounting portion 42.

Partially open wall 32 may include a weatherstrip channel 44 having a weatherstrip 46 therein. Weatherstrip 46 closes any gap between door 10 and firestop 24A.

Figure 4:
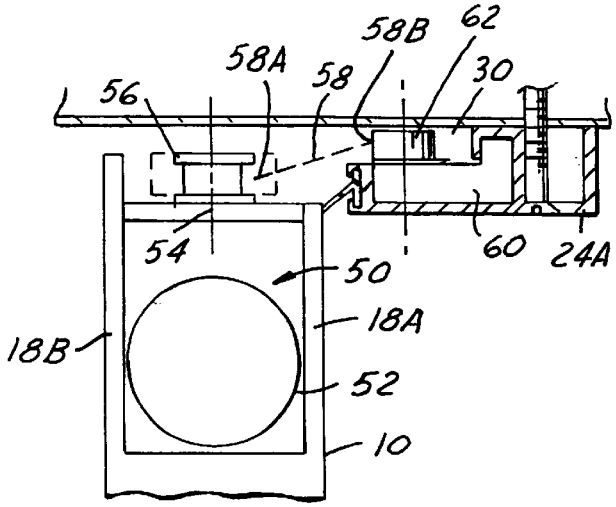
FIG. 4 is a cross-sectional view of a door having a door closer in position with a firestop mounted to a header of a door frame according to the present invention.

Referring now to FIG. 4, the relative position of door 10 and firestop 24A is illustrated. Door 10 preferably has a closer 50 positioned between outer faces 18A and 18B. This configuration provides an aesthetically pleasing door in which assembly is only minimally visible.

Closer assembly 50 includes a biasing element 52 that has a pivot axis 54 extending therefrom. Pivot axis 54 may have a bushing 56 positioned thereon. Closer assembly 50 also includes an arm 58 having a first end 58A and a second end 58B. First end 58A is coupled to bushing 56 so that arm 58 rotates therearound. Arm 58 is illustrated as a dash line for simplicity purposes and will be further illustrated below. The pivot axis 56 remains stationary relative to the door. The unit thus has a restoring force to close the door caused by the internal mechanism of the biasing element 52 about the pivot axis 56.

A slider 60 is positioned within firestop 24A. Slider 60 slides within channel 30 as the door moves from a closed position to an open position and back again. Slider 60 has an arm retainer 62 that is used to rotatably couple to second end 58B of arm 58.

Figure 5C:
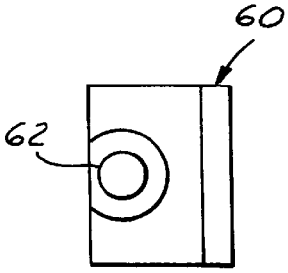
FIGS. 5A, 5B, and 5C are elevational views of a slider used in the present invention.
Figure 5A:
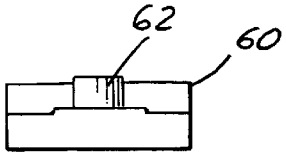
Figure 5B:
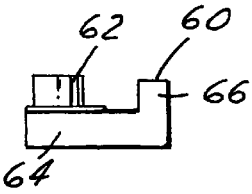

Referring now to FIGS. 5A, 5B, and 5C, respective front, side and top views of slider 60 are illustrated. As mentioned above, slider 60 has arm retainer 62 extending from a main body 64. With respect to the relative position of the door, retainer 62 extends upward from main body 64. A retainer arm 66 also extends in upward direction from main body 64. Retainer arm 66 in conjunction with wall 40 help retain slider 60 within channel 30. Preferably, slider 60 is made from a resilient material such as plastic, Delrin® or nylon. Channel 30 may also include a lubricant (not illustrated) to assist in the smooth operation of slider 60.

Preferably, arm 58 is placed over arm retainer 62 without the use of fasteners. Of course, as will be further described below, fasteners may be used to secure arm 58 to slider 60 depending on the geometric configuration.

Figure 6:
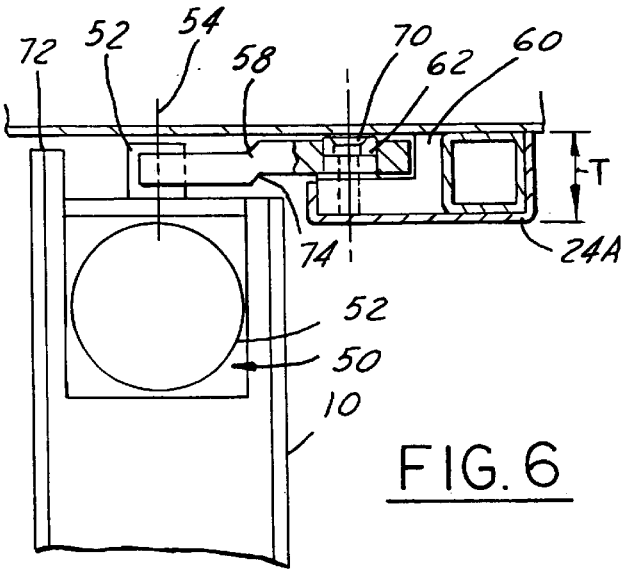
FIG. 6 is a cross-sectional view of an assembled closer assembly according to the present invention.

Referring now to FIG. 6, another embodiment illustrates arm 58 coupled to slider 60' through the use of a fastener 70. As can be seen, retainer 62, arm 58, and pivot bushing 56 lie on a substantially horizontal pg,10 plane. Also, the top edge 72 of door 10 also lies in the same substantially horizontal plane. To phrase it in another way, the thickness T of firestop 24A if extended over to the door includes slider 60, arm 58, bushing 56, and top portion of door 72. That is, slider 60, arm 58, bushing 56, and top portion of door 72 extend only a predetermined distance below the header 14 which corresponds to thickness T. Arm 58 in this embodiment is not entirely horizontal and thus has a slight elbow 74 to avoid partial wall 32.

Figure 7:
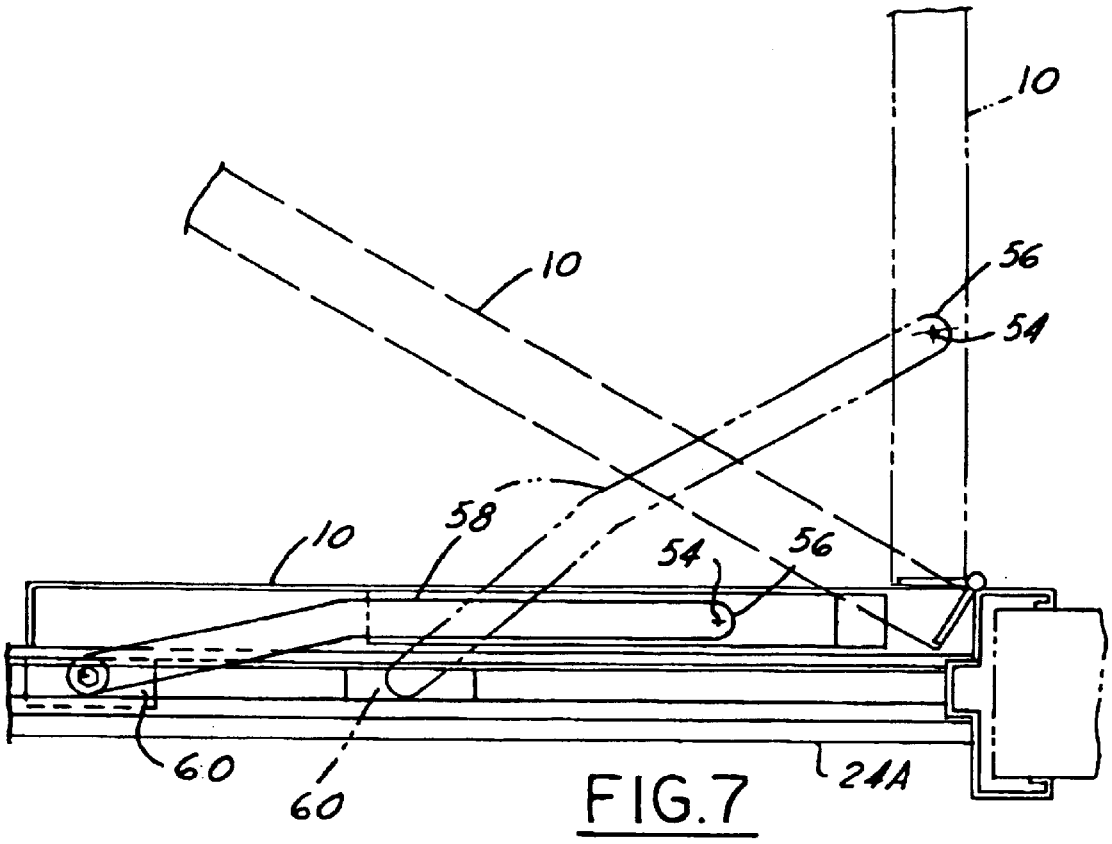
FIG. 7 is a top view of a closer assembly having a closer arm.

Referring now to FIG. 7, a door 10 is illustrated in a closed position and a partially open position (in dashed lines). As can be seen, bushing 56 remains fixed within door 10 while being rotatably coupled to arm 58. Simultaneously, slider 60 moves within channel 30 as toward hinge 26. As is illustrated, in a closed position, slider 60 is in the leftmost position while in a partially open position slider 60 moves to the right within channel 30. The biasing element 50 provides a biasing effort to close the door as is known to those skilled in the art.

Arm 58 is illustrated having a slight angular or "dog-leg" configuration.

Figure 7A:
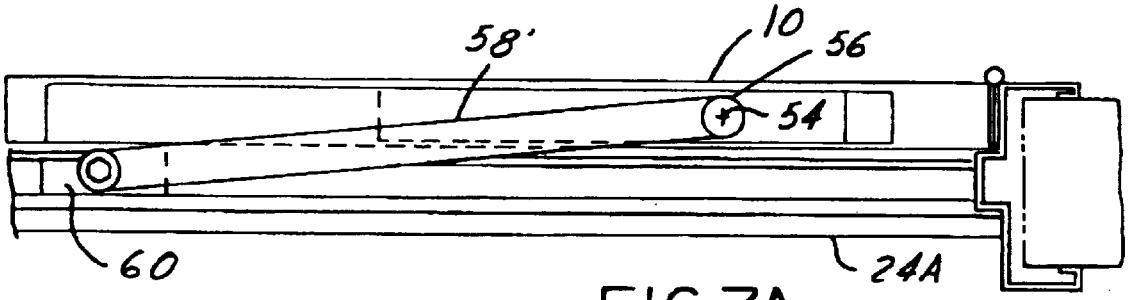
FIG. 7A is a top view of a closer assembly similar to FIG. 7 using an alternative closer arm.

Referring now to FIG. 7A, arm 58 may also have a straight arm 58' depending on the geometry of the closer, door and door opening.

Figure 8:
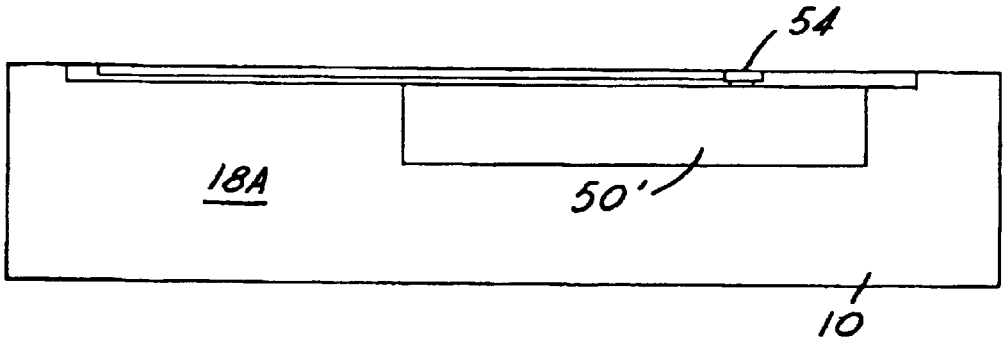
FIG. 8 is an elevational view of a door having an externally mounted closer according to the present invention.

Referring now to FIG. 8, a closer assembly 50' may be coupled outside door 10. That is, door closer assembly 50' may be coupled to the push side door face 18A or 18B. In the exterior mounted configurations, slider 60 still slides within a similar firestop channel 30 as described above.

Figure 9:
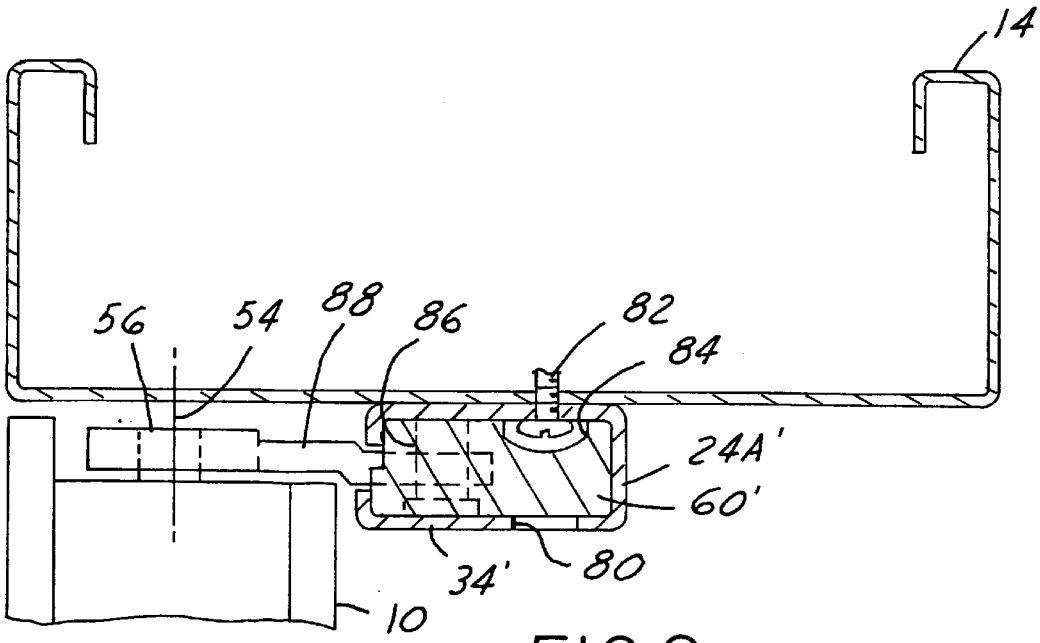
FIG. 9 is a cross-sectional view of an alternative embodiment of a firestop according to the present invention.

Referring now to FIG. 9, header 14 is illustrated with an alternative cross section of a firestop 24A. In this embodiment, firestop 24A' is generally C-shaped and has a modified slider 60' positioned therein. Horizontal wall 34' has an opening 80 therein so that a fastener 82 may be used to secure firestop 24' to horizontal header 14. Slider 60' has a groove 84 to prevent interference between slider 60' and fastener 82. A pin 86 may be used to couple arm 88 to slider 60'.

Figure 10:
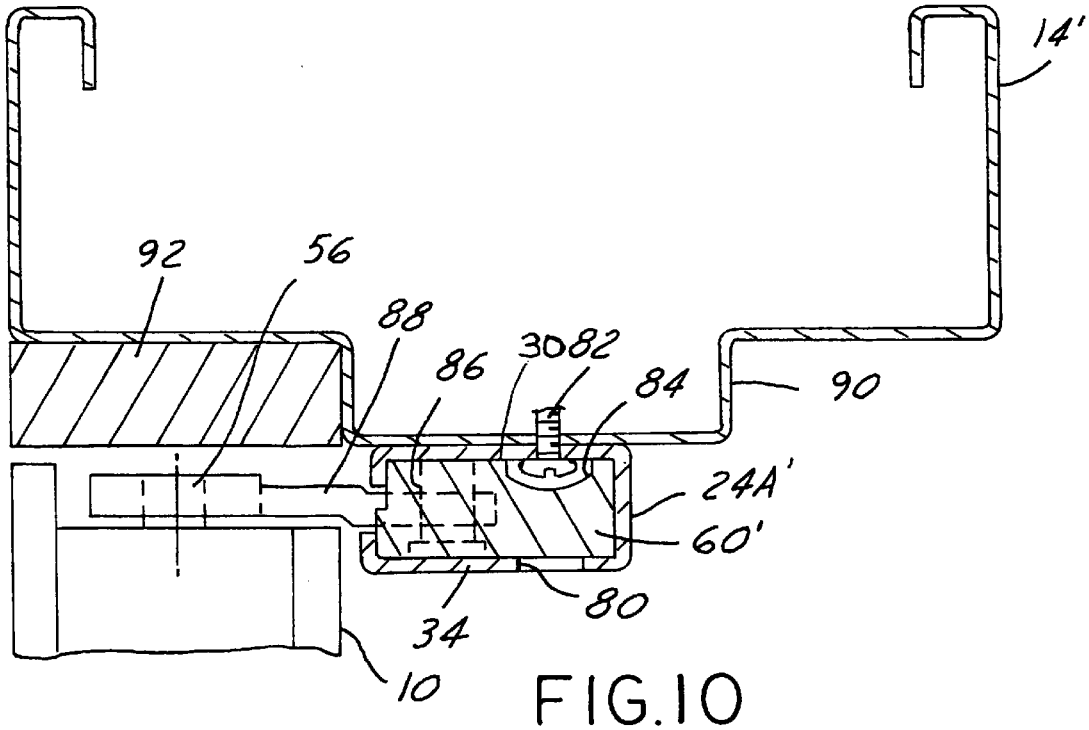
FIG. 10 is a cross-sectional view of a retrofit door according to the present invention.

Referring now to FIG. 10, an embodiment similar to that of FIG. 9 is illustrated. Therefore, the same reference numerals are used to indicate the same components. The firestop 24A' and slider 60' are the same as FIG. 9. However, the firestop 24A' could also have other configurations such as those shown in FIGS. 3–5C. In this embodiment, horizontal header 14' has been modified from that shown in the above figures. This embodiment is particularly useful for a pre-existing door frame. That is, the door frame 14' is referred to in the industry as a rabbetted header that includes an integral firestop 90. If, however, a door closer is desired to be employed according to the present invention, firestop 24A' is coupled to header 14' on the previous firestop 90. To align firestop 24A' with door 10, door 10 is shortened in height. To provide a more finished surface, a filler 92 may be positioned on header 14' to conceal that the door length has been reduced.

In operation, it is preferred that the door and door closer assembly are assembled in a factory environment rather than on the jobsite. However, the present invention applies to either situation. The conventional firestop of a door is replaced with a firestop configured according to the present invention having a channel 30 therein. The channel 30 allows the slide to move therein in a nearly concealed and aesthetically pleasing manner. In a retrofit configuration such as that described in FIG. 10 above, a new firestop is coupled to the door frame. The firestop has an at least partially open side so that the arm with the slider in channel 30 may move therein. The closer is mounted so that a biasing force on the arm allows the door to move to a closed position when opened.

When the present invention is used in a pre-existing door environment, the new firestop track with open channel 30 is coupled to the existing header. The door is then reduced in height and a closer assembly is coupled to the door. The slider assembly may be coupled externally or between the door panels. The slider is positioned within the channel which in turn is coupled to the closer arm for operation.

Advantageously, the present invention may be configured in a factory environment to allow testing and alignment of the door closer and door within the frame. This is one less operation that the trades are required to perform and therefore the overall cost of the installation of the door within the opening is reduced.

While particular embodiments of the invention have been shown and described, numerous variations and alternate embodiments will occur to those skilled in the art. Accordingly, it is intended that the invention be limited only in terms of the appended claims.

What is claimed is:

1. A door assembly comprising:

a door frame having a horizontal header;

a firestop extending downwardly from said header, said firestop having a plurality of sides defining an open channel therein, said firestop having an at least partially open side;

a door rotatably mounted within the door frame; and a door closer assembly coupled to said door, said door closer assembly having a biasing assembly, and an arm having a first end and a second end, said first end coupled to said biasing assembly and said second end slidably coupled within said channel.

2. A door assembly as recited in claim 1 wherein said door has an open position and a closed position, said at least partially open side is positioned adjacent to said door.

3. A door assembly as recited in claim 2 wherein said firestop comprises a weatherstrip mounting guide and said door assembly further comprising a weatherstrip positioned between said door and said firestop when said door is in said closed position.

4. A door assembly as recited in claim 1 wherein said partially open side is fully open.

5. A door assembly as recited in claim 1 wherein said door assembly comprises an inner face adjacent to said firestop and an outer face, said biasing assembly coupled between said inner face and said outer face.

6. A door assembly as recited in claim 1 wherein said door assembly comprises an inner face and an outer face, said biasing assembly coupled between said inner face and said outer face.

7. A door assembly as recited in claim 1 wherein said door closer assembly comprises a slider rotatably coupled to said second end, said slider slidably coupled within said channel.

8. A door assembly as recited in claim 1 wherein said firestop is C-shaped.

9. A door assembly as recited in claim 1 wherein said firestop comprises a substantially G-shaped portion having said channel therein and a mounting portion coupled to said substantially G-shaped portion.

10. A door assembly as recited in claim 1 wherein said arm is substantially horizontal.

11. A door assembly as recited in claim 1 wherein said arm is horizontally adjacent to said firestop.

12. A door assembly as recited in claim 1 wherein said biasing assembly has a pivot axis extending therefrom, said door having a top, said pivot axis, said top and said firestop being horizontally adjacent when said door is in a closed position.

13. A door assembly comprising:

a door frame having a horizontal header;

a firestop extending downwardly a predetermined distance from said header, said firestop having a plurality of sides defining a channel therein, said firestop having an at least partially open side;

a door rotatably mounted within the door frame; and a door closer assembly coupled to said door, said door closer assembly having a biasing assembly, an arm having a first end and a second end and a slider slidably coupled within said channel, said first end coupled to said biasing assembly and said second end rotatably coupled to said slider.

14. A door assembly as recited in claim 13 wherein said arm and said slider extend less than said predetermined distance from said header.

15. A door assembly as recited in claim 13 wherein said door closer assembly comprises a bushing, said bushing extending less than said predetermined distance from said header.

16. A door assembly as recited in claim 13 wherein said door has a top, said top positioned within said predetermined distance from said header.

17. A door assembly as recited in claim 13 wherein said at least partially open side is a vertical side.

18. A door assembly as recited in claim 13 wherein said door has an open position and a closed position, said at least partially open side is positioned adjacent to said door in said closed position.

19. A door assembly as recited in claim 13 wherein said partially open side is fully open.

20. A door assembly as recited in claim 13 wherein said arm is substantially horizontal.

21. A method of forming a door assembly comprising:

mounting a firestop to a header of a door frame, said firestop having an at least partially open side and a channel defined therein;

mounting a closer assembly having an arm extending therefrom to a door; and slidably coupling the arm to the channel.

22. A method as recited in claim 21 wherein coupling the arm to the channel comprises rotatably coupling the arm a slider and inserting the slider within the channel.

23. A method as recited in claim 21 further comprising the step of reducing a height of the door and coupling a filler to the door frame.

* * * * *